US007850007B2

(12) United States Patent
Birds

(10) Patent No.: US 7,850,007 B2
(45) Date of Patent: Dec. 14, 2010

(54) APPARATUS FOR STORING AND TRANSPORTING WATERCRAFT PROPELLERS

(76) Inventor: Steven J. Birds, 27943 Seco Canyon Rd., #145, Santa Clarita, CA (US) 91350

( * ) Notice: Subject to any disclaimer, the term of this patent is extended or adjusted under 35 U.S.C. 154(b) by 0 days.

(21) Appl. No.: 12/151,084

(22) Filed: May 1, 2008

(65) Prior Publication Data

US 2008/0205797 A1 Aug. 28, 2008

Related U.S. Application Data

(63) Continuation-in-part of application No. 11/489,023, filed on Jul. 18, 2006, now abandoned.

(60) Provisional application No. 60/701,233, filed on Jul. 20, 2005.

(51) Int. Cl.
*B65D 33/06* (2006.01)
*B65D 30/10* (2006.01)

(52) U.S. Cl. ..... 206/522; 206/583; 206/592; 383/6; 383/3

(58) Field of Classification Search ..... 206/522, 206/583, 856, 591, 592, 593, 594, 319; 24/614, 24/615, 630, 631, 632, 633; 224/578, 579, 224/580, 178; 383/6, 3
See application file for complete search history.

(56) References Cited

U.S. PATENT DOCUMENTS

| | | | | | |
|---|---|---|---|---|---|
| 4,801,213 | A * | 1/1989 | Frey et al. | ..... | 383/3 |
| 4,951,818 | A * | 8/1990 | Johnson | ..... | 206/315.1 |
| 5,103,945 | A * | 4/1992 | Kaneko | ..... | 190/107 |
| 5,170,745 | A * | 12/1992 | Burdette, Jr. | ..... | 119/497 |
| 5,624,035 | A * | 4/1997 | Kim | ..... | 206/522 |
| 5,659,931 | A * | 8/1997 | Anscher | ..... | 24/614 |
| 6,199,693 | B1 * | 3/2001 | Hung | ..... | 206/349 |

* cited by examiner

*Primary Examiner*—Ehud Gartenberg
*Assistant Examiner*—King M Chu
(74) *Attorney, Agent, or Firm*—James M. Duncan, Esq.; Klein, DeNatale, Goldner, et al.

(57) ABSTRACT

An apparatus for carrying and storing watercraft propellers comprises a soft-shell enclosure having a rigid bottom member. The apparatus further comprises means for securing the propeller within the enclosure. An embodiment of the apparatus may shaped in the form of a cube or other parallelepiped with an opening symmetrically bisecting the enclosure along the top and the sides, or a top with a single panel defining the bottom of the enclosure. Alternatively, the apparatus may have a cylindrical shape. An embodiment of the invention may further comprise an inflatable support member for protecting the propeller.

5 Claims, 11 Drawing Sheets

APPARATUS FOR STORING AND TRANSPORTING WATERCRAFT PROPELLERS

CROSS-REFERENCE TO RELATED APPLICATIONS

This application is a CIP of U.S. patent Ser. No. 11/489,023 filed on Jul. 18, 2006, which application claimed priority to U.S. Provisional Application No. 60/701,233 filed on Jul. 20, 2005, for which applications the inventor herein claims domestic priority, and which applications are incorporated herein by reference.

BACKGROUND OF THE INVENTION

The present invention generally relates to the storage and transportation of propellers for watercraft. In particular, embodiments of an apparatus are disclosed which facilitate the transportation of propellers, protect the propeller from damage, and prevent injury to the person transporting the propeller.

It is common for boating and jet ski enthusiasts to have at least one spare propeller for their craft. A propeller may be damaged, in which case the spare may be required. In addition, because the pitch of the propeller affects the engine RPM, a boat owner may have different propellers for different operating conditions, such as for high altitude service. However, carrying and/or storing propellers can be problematic. Powerboat propellers come in common sizes with a range of 14.5 inches through 20 inches, making a universally-sized carrying apparatus problematic. Specially designed propellers for racing craft can be very expensive—a single propeller can cost tens of thousands of dollars. Propellers are typically heavy and have sharp edges. If the spare propeller is allowed to simply sit in a storage compartment of the boat, the edges may be damaged by shifting equipment, or the bare edges may injure someone. Carrying propellers can be difficult as well because of the heaviness and lack of convenient handholds. Dropping a propeller can result in damage to the propeller and harm to the person carrying it, or persons in the vicinity.

SUMMARY OF THE INVENTION

The apparatus disclosed herein provides a solution to the need identified above. An embodiment of the invention comprises a soft-shell enclosure which may be shaped in the form of a cube or other parallelepiped with an opening symmetrically bisecting the enclosure along the top and the sides, with a single panel defining the bottom of the enclosure. The enclosure thereby functions in a clam-shell manner, with opposing halves of the enclosure capable of being widely spread apart for insertion of the propeller. The invention further comprises a rigid bottom member which overlies the single panel on the bottom, and which provides support for the propeller. The opening has opening and closing means, such as a zipper. The invention further comprises carrying means such as a continuous loop strap which is attached to and supports the bottom and sides of the enclosure, and which extends above each side of the enclosure in matching loops.

Alternatively, the apparatus may comprise a cylindrical soft shell enclosure with a panel defining the bottom of the enclosure. The cylindrical soft shell comprises an opening at the top which may be closed with zippers, buttons, cinch cord, or hook and loop fasteners. This embodiment further comprises a rigid bottom member which overlies the panel on the bottom, and which provides support for the propeller. The rigid bottom member may comprise means for securing the propeller to the enclosure bottom panel. The apparatus may further comprise an inflatable support and protection means which further secures a propeller within the enclosure and provides impact protection if the apparatus is either dropped or struck. This feature allows a bag of a single size to accommodate propellers of different sizes, because the inflatable support inflates around the outside diameter of the propeller, cradling it, and thereby allowing a single size bag to be utilized for different sizes of propeller.

DETAILED DESCRIPTION OF THE EMBODIMENTS OF THE INVENTION

Figure 1:
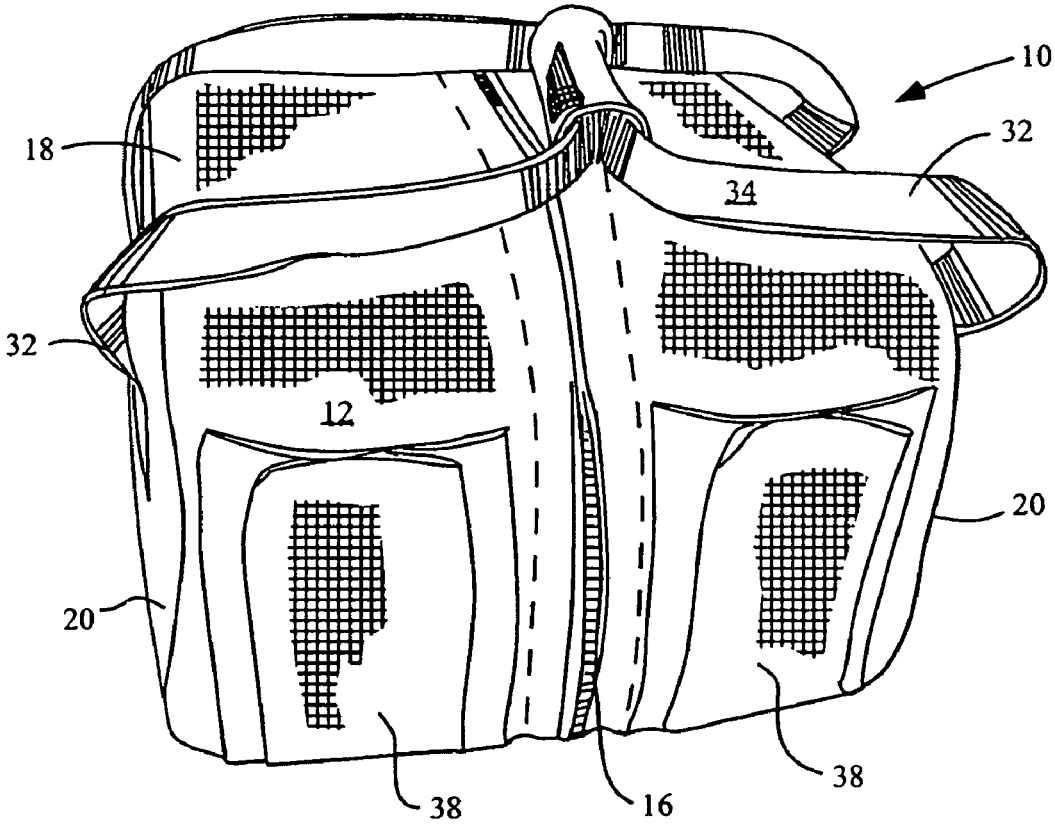
FIG. 1 shows a front view of an embodiment of the disclosed device.
Figure 5:
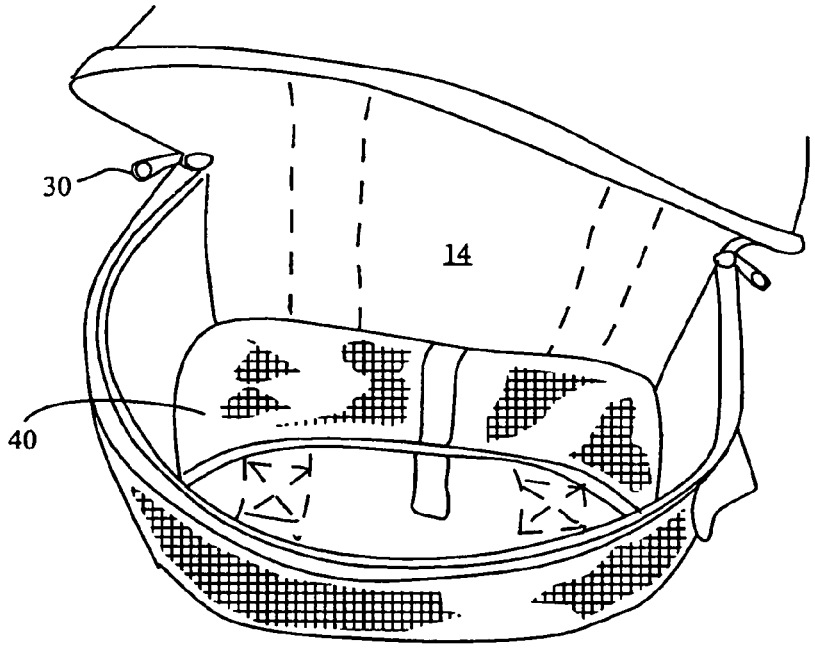
FIG. 5 shows an inside view of the embodiment shown in FIG. 1.
Figure 11:
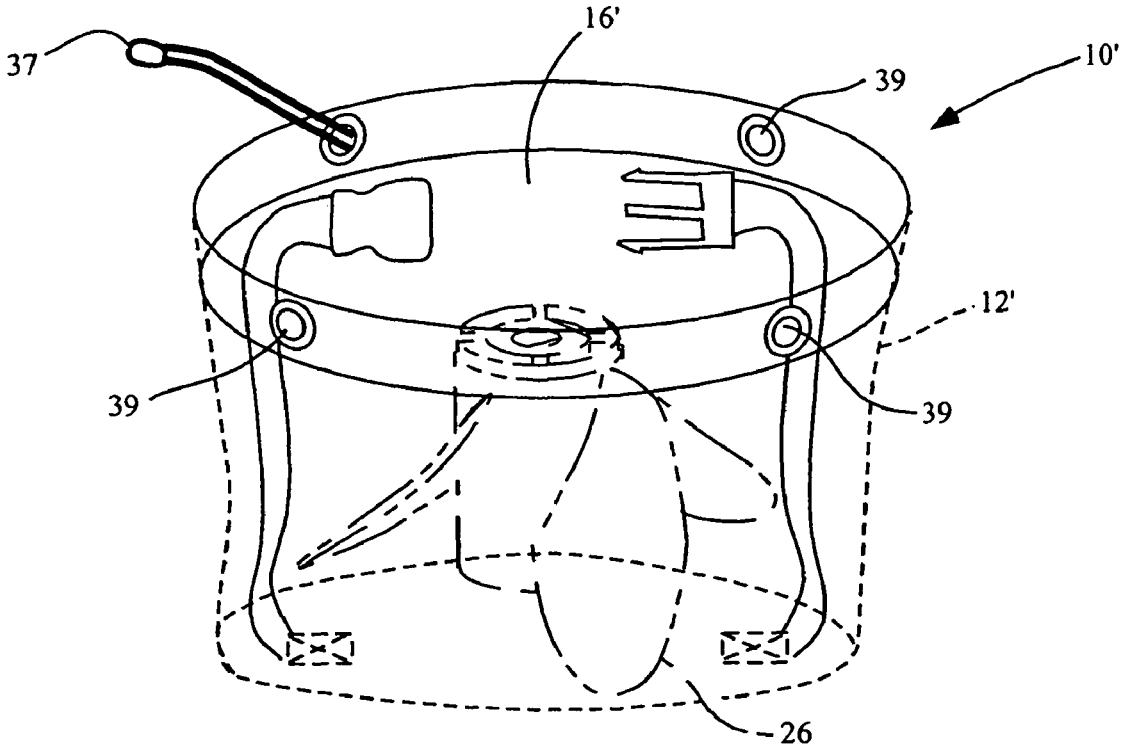
FIG. 11 shows an alternative embodiment of the device wherein the soft-shell enclosure is in a cylindrical shape, which utilizes grommets and a draw cord for closing the opening of the device.
Figure 12:
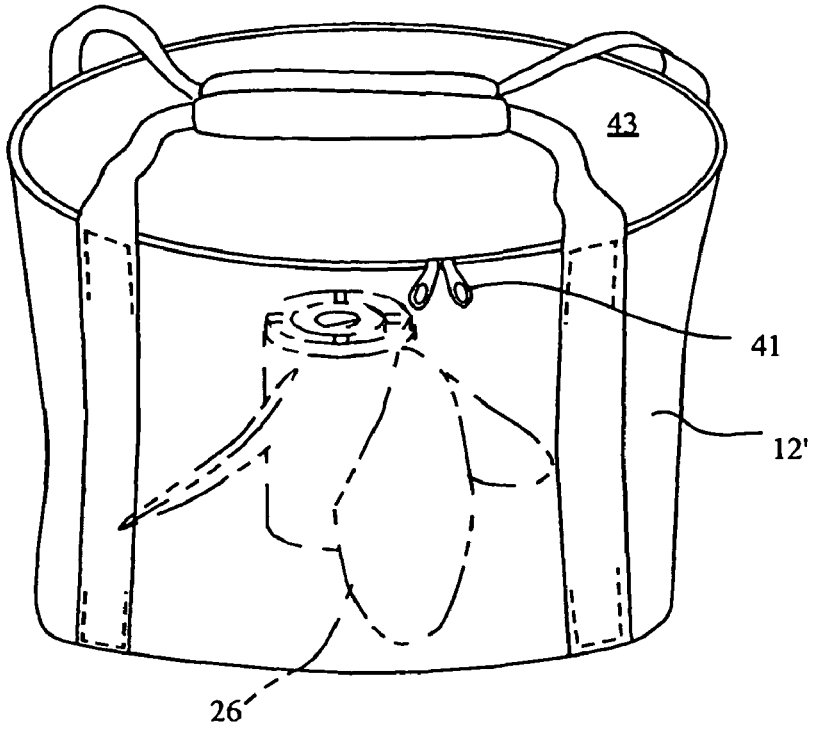
FIG. 12 shows an alternative embodiment of the device wherein the soft-shell enclosure is in a cylindrical shape, which utilizes a zipper for closing the opening of the device.
Figure 13:
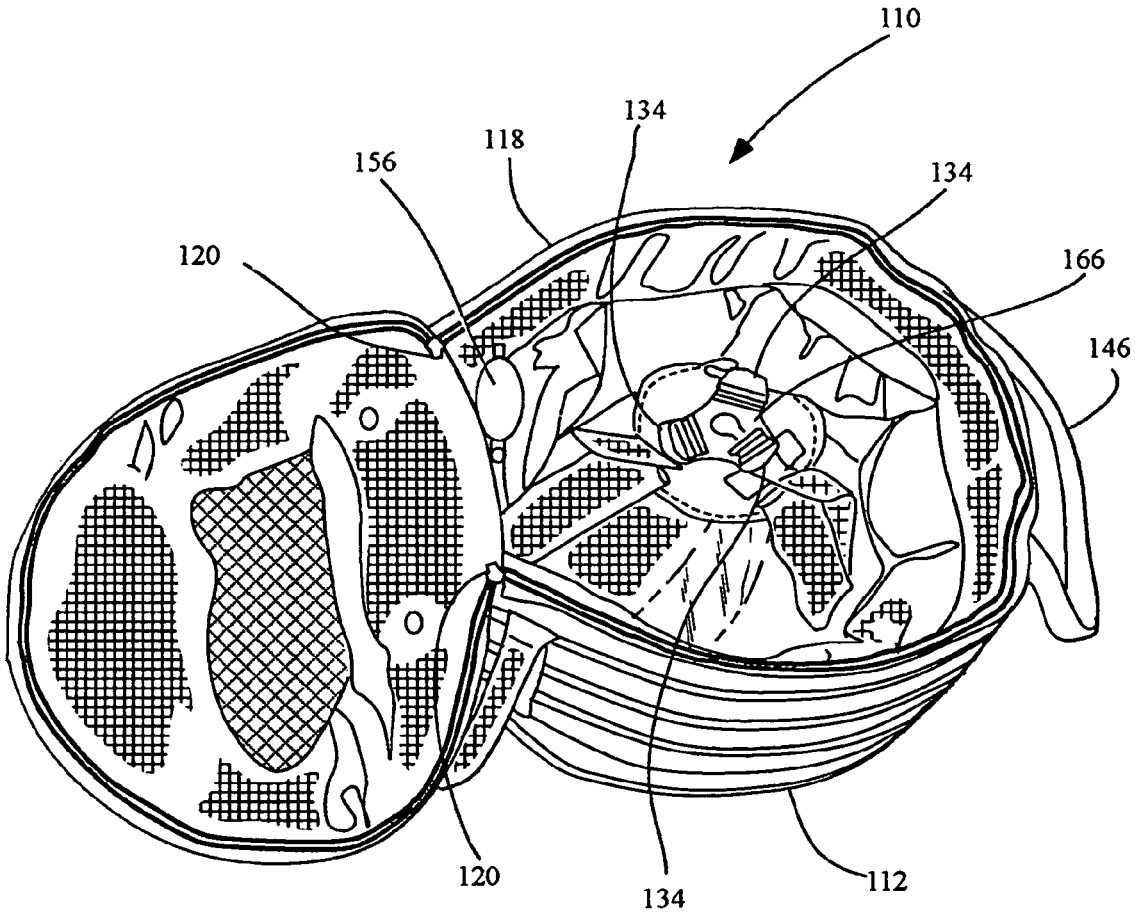
FIG. 13 shows an alternative embodiment of the device wherein the device comprises an inflatable support and protection means to further protect the propeller.

Referring now specifically to the drawings, FIG. 1 shows an embodiment 10 of the invention. This embodiment 10 comprises a soft-shell enclosure 12 which may shaped in the form of a cube or other parallelepiped. Alternatively, as shown in FIGS. 11-13, the soft shell enclosure 12', 112 may be configured in a cylindrical shape. The enclosure 12 (or 12', 112) may be manufactured from soft-sided material with sufficient strength, such as ballistic nylon, canvas, CORDURA, KEVLAR, or SuperFabric® brand material by Higher Dimension Materials, Inc. The enclosure 12 may also have a nylon lining 14 in the interior of the enclosure as shown in FIG. 5. Foam material may be sandwiched between the outer layer of the enclosure 12 and the lining 14. This foam material may have a thickness of 0.25 inch.

Figure 8:
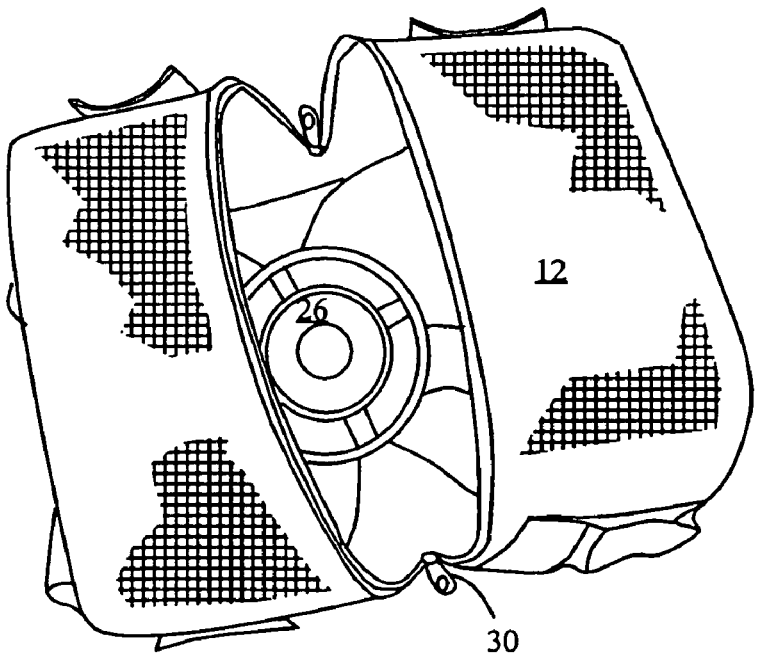
FIG. 8 shows an embodiment of the disclosed device with a propeller disposed therein.
Figure 9:
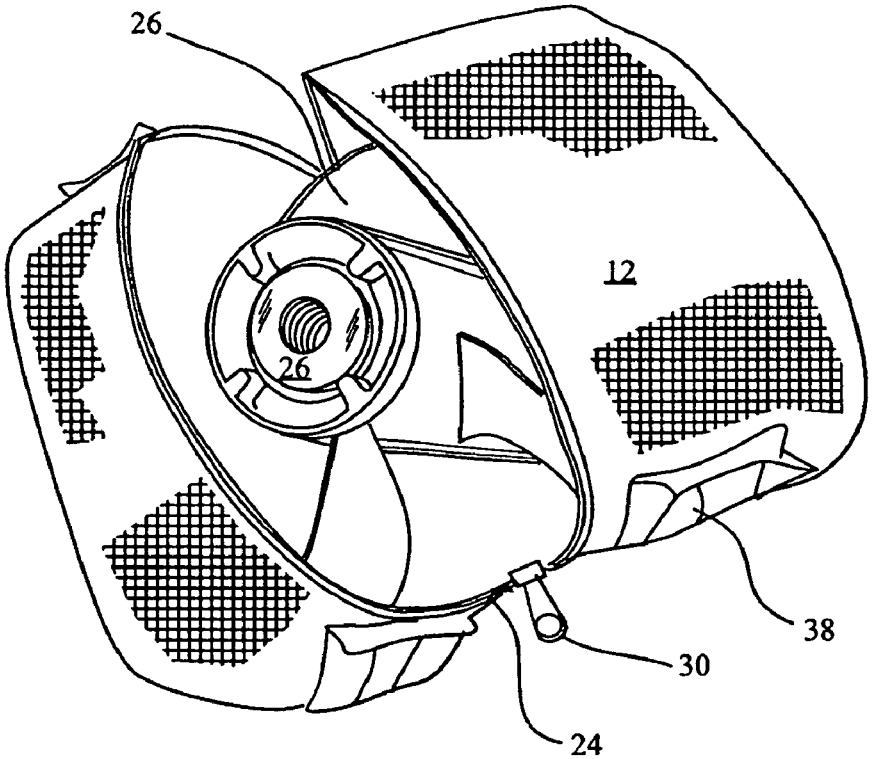
FIG. 9 shows another view of an embodiment of the disclosed device with a propeller disposed therein.

Embodiment 10 may further comprise an opening 16 which may symmetrically bisect the enclosure 2 along the top 18 and the sides 20. A single panel 22 defines the bottom of the enclosure 12 for this embodiment 10. The enclosure 12 may thereby function in a clam-shell manner, with opposing halves of the enclosure capable of being widely spread apart for insertion of the propeller as shown in FIGS. 8 and 9.

As shown in FIGS. 11-12, an embodiment 10' of the apparatus has a cylindrical enclosure 12' comprising an opening 16' which is sufficiently large to allow one or more propellers to be inserted through the opening into the apparatus.

Figure 7:
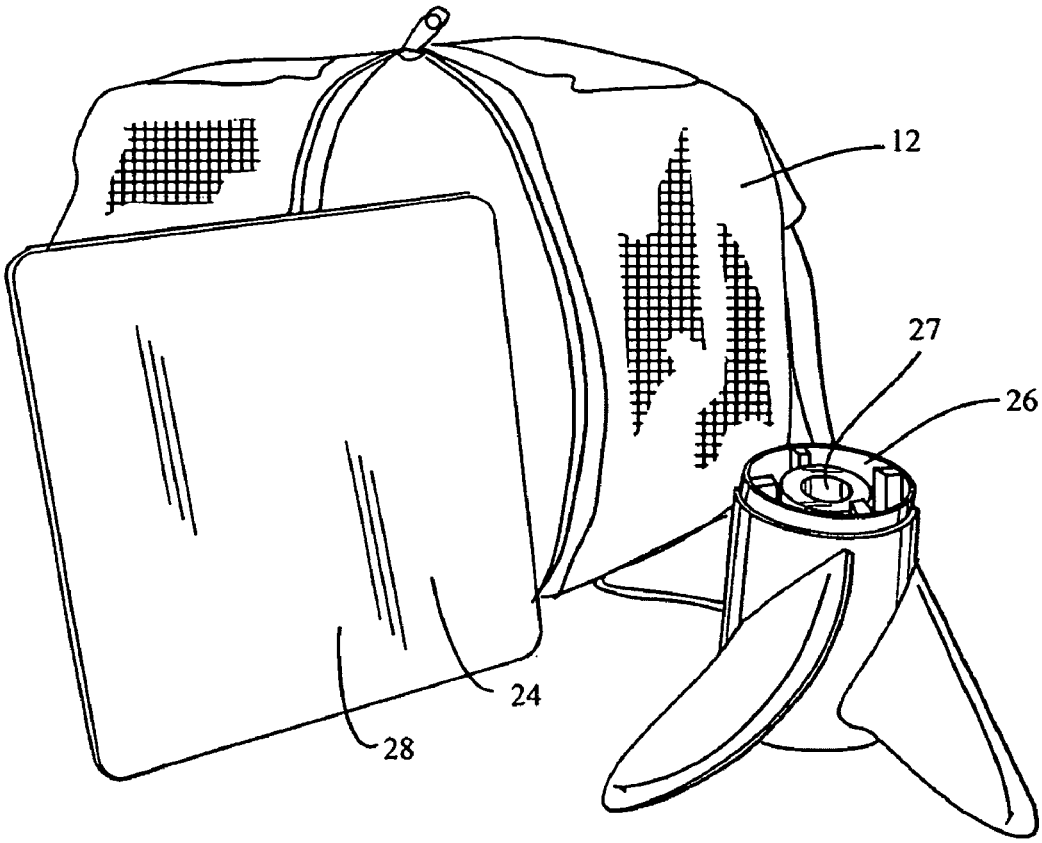
FIG. 7 shows an embodiment of the disclosed device with the rigid bottom member removed, along with a propeller.

The invention further comprises a rigid bottom member 24 which overlies the single panel 22 on the inside of the enclosure 12. This rigid bottom member 24 provides support for the propeller 26. The rigid bottom member 24 may comprise a lightweight yet strong material such as acrylonitrate-butadiene-styrene (i.e., ABS plastic). It has been found that material having a thickness of ¼" or greater provides sufficient strength for most size propellers. As indicated on FIG. 7, the rigid bottom member 24 may further comprise a textured top surface 28, such as indoor-outdoor carpet, to make the inside of the enclosure 12 more appealing.

Figure 6A:
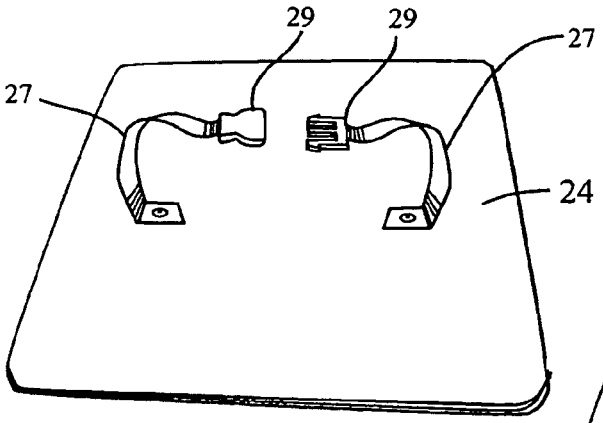
FIG. 6A shows an embodiment of the rigid bottom member of an embodiment of the device which employs straps as a means of securing a propeller to the rigid bottom member.
Figure 6B:
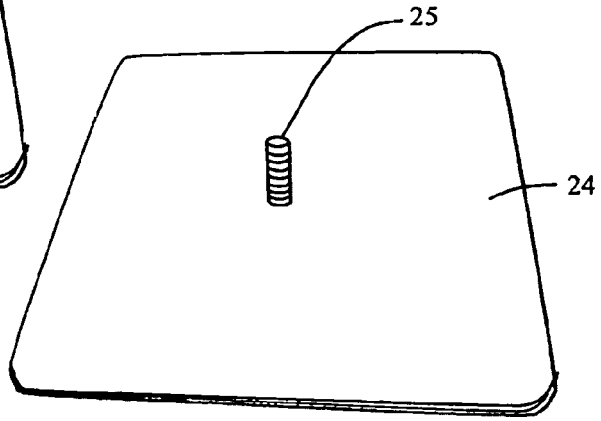
FIG. 6B shows an embodiment of the rigid bottom member of an embodiment of the device which employs a threaded stud as a means of securing a propeller to the rigid bottom member.

The rigid bottom member 24 may further comprise means for securing the propeller 26 to the bottom member. Various means may be employed for this purpose. For example, the rigid bottom member 24 may comprise a vertical threaded stud member 25 which may be inserted through the splined bushing in the hub 27 that attaches the propeller to the propeller shaft. A retaining nut or other fastener may then be attached to the threaded stud member 25, such that the retaining nut makes up against the propeller hub 27 to retain the propeller 26 in place. Another means for securing the propeller 25 to the rigid bottom member 24 is shown in FIG. 6B. As shown in FIG. 6B, the rigid bottom member 24 may comprise adjustable straps 27 which are secured at one end to the rigid bottom member and which have connectors 29 at the other end for securing to a mating strap 27.

Figure 2:
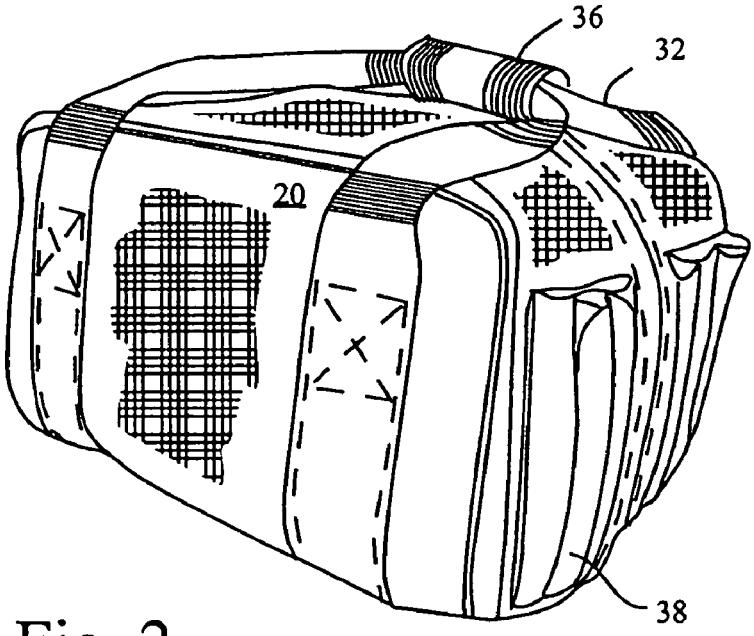
FIG. 2 shows a side view of the embodiment shown in FIG. 1.
Figure 3:
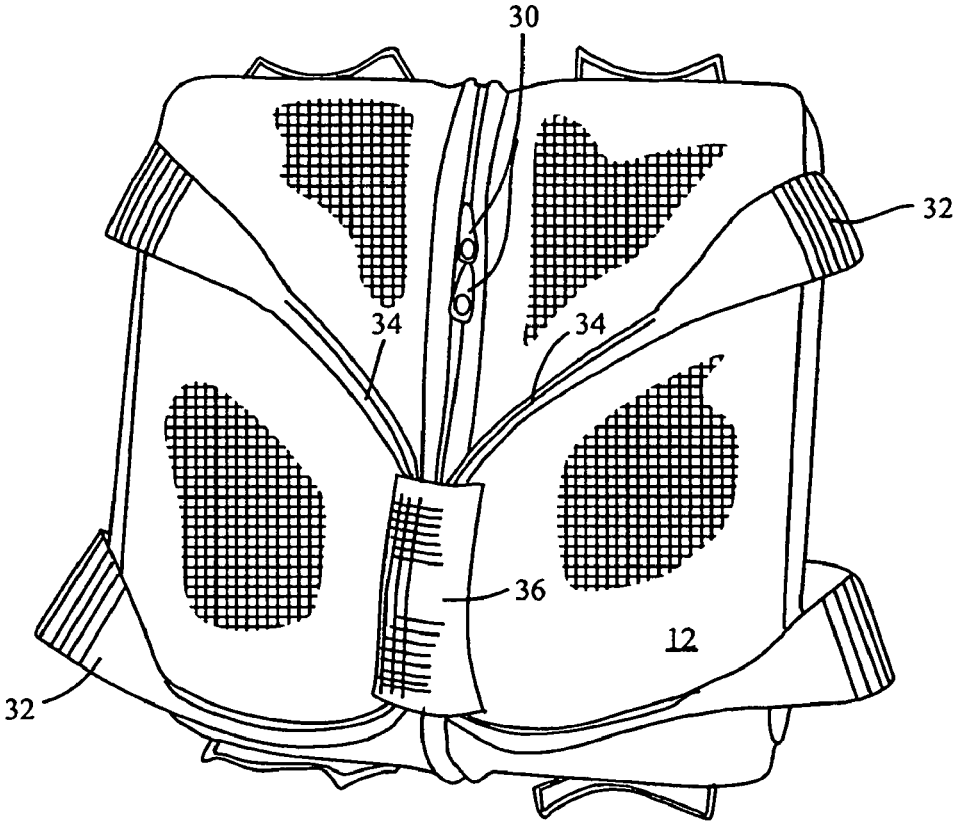
FIG. 3 shows a top view of the embodiment shown in FIG. 1.
Figure 4:
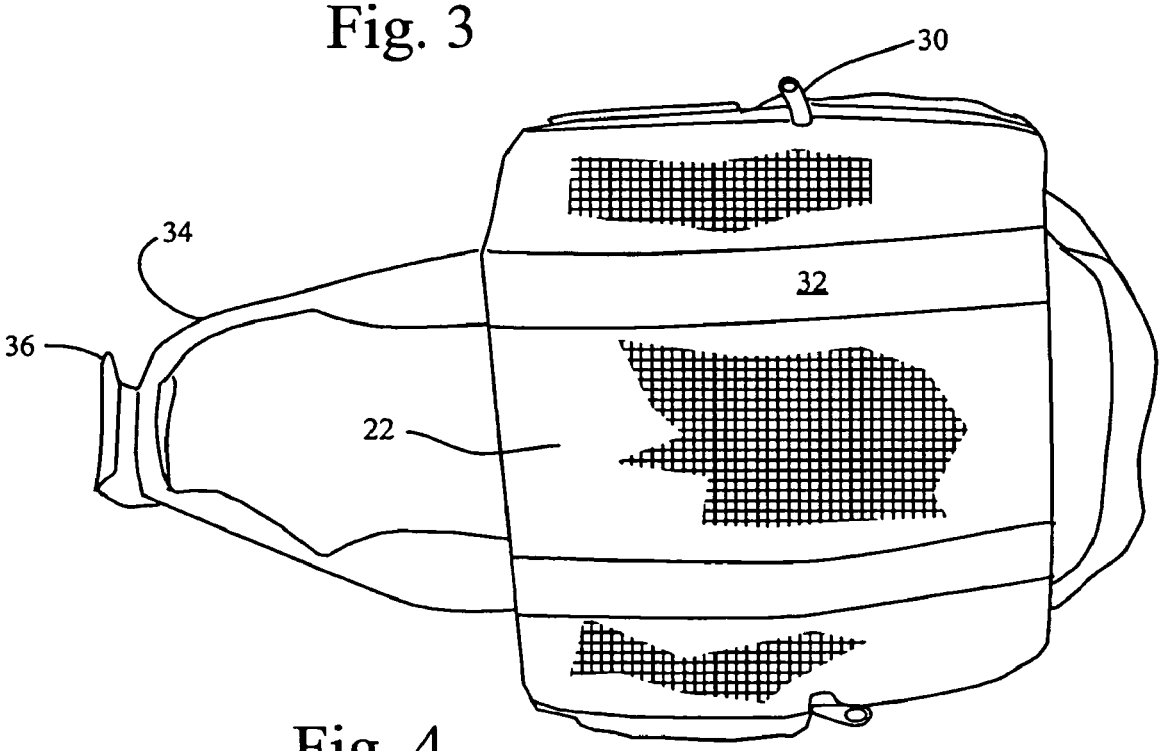
FIG. 4 shows a bottom view of the embodiment shown in FIG. 1.

The opening 16 of embodiment 10 has opening and closing means, such as a zipper 30. As shown in FIG. 3, dual zippers 30 may be used to facilitate opening the enclosure 12 The invention further comprises carrying means such as a continuous loop strap 32 which is attached to and supports the single panel 22 defining the bottom and sides 20 of the enclosure 12 as shown in FIGS. 1 through 4. The continuous loop strap 32 which extends above each side of the enclosure and terminates in matching loops 34, which provide a convenient handle for carrying the apparatus. As shown in FIG. 2, the continuous loop strap 32 may be double stitched to the exterior of the enclosure 12 to provide additional security and carrying capacity. A handle piece 36 may also be utilized to provide additional support for grasping the apparatus.

In the embodiment 10' having a cylindrical shell, opening 16' may be closed with various closing means. For example, draw cord 37 may be disposed within an upper seam of the shell bordering the opening 16', where the draw cord is accessible through grommets 39. Alternatively, zipper 41 may be employed to close top panel 43.

Figure 10:
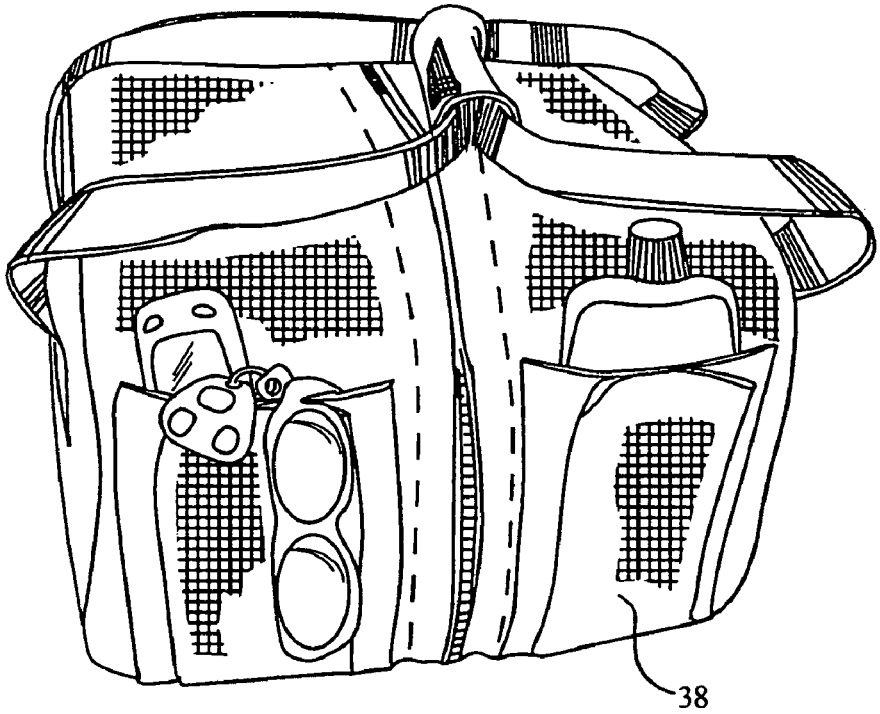
FIG. 10 shows a front view of an embodiment of the disclosed device showing usage of the exterior utility pockets.

The device may further comprise exterior utility pockets 38 which may be used to carry an assortment of different objects. An example for usage of the exterior utility pockets is shown in FIG. 10. The device may further comprise interior utility pockets 40 as shown in FIG. 5. These pockets may be utilized for carrying additional hardware such as shear pins or cotter pins or for carrying the tools necessary for changing out the propeller 26.

The embodiment 110 shown in FIG. 13 has a cylindrical shell 112, sides 114, the enclosure having an opening 118, wherein the opening of the enclosure comprises closing means 120 in the form of a zipper, and means for securing the propeller 126 to the enclosure bottom panel 122. The means for securing the propeller 126 to the enclosure bottom panel 122 may comprise straps 130. The straps 130 can further comprise cover sleeves 148 which serve to protect the strap from being damaged by the blades of propeller 126. The device comprises carrying means such as straps 146 which may comprise a continuous loop strap attached to the sides of the enclosure, and which extends above each side of the enclosure in matching loops. The apparatus may further comprise a rigid bottom member 158 which overlies the enclosure bottom panel 122, where the straps 130 extend around the rigid bottom member 158.

The apparatus may further comprise inflatable support and protection means such as internal bladder 152. When inflated, internal bladder 152 provides support and further secures propeller 126 within the enclosure, reducing movement of the propeller within the bag and providing impact protection to the propeller if the bag is either dropped or struck. Internal bladder 152 forms an inflated circle around the propeller 126. This feature allows the same size apparatus to be utilized for different diameter propellers, because the internal bladder 152 prevents smaller diameter propellers from sliding or moving around within the apparatus, and prevents the edges of the sharp propeller blades from coming into contact with the inside surfaces of the enclosure.

Figure 19:
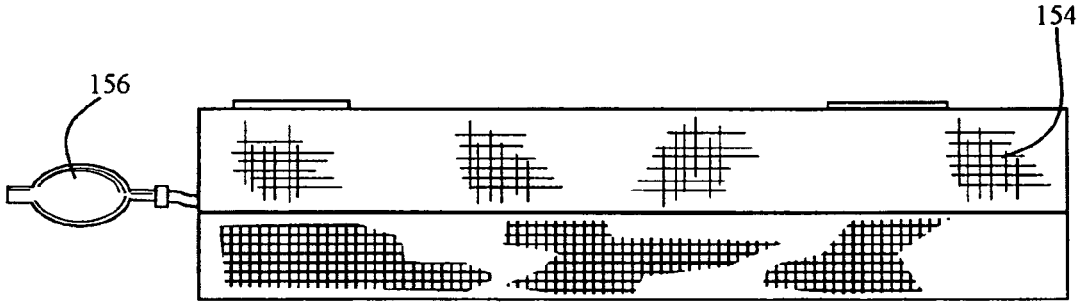
FIG. 19 is a side view of an embodiment of an internal bladder which may be utilized as the inflatable support and protection means.
Figure 20:
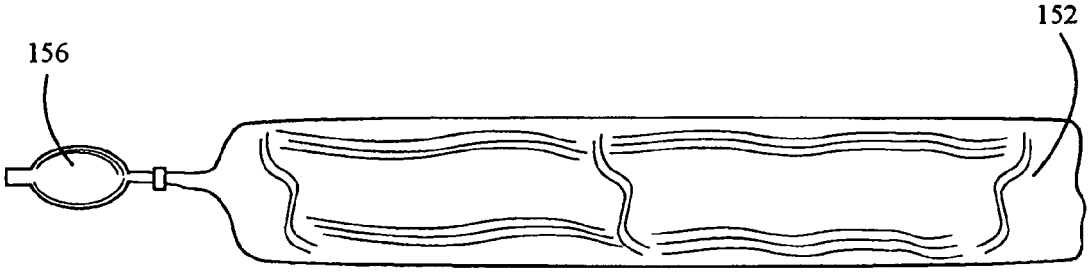
FIG. 20 is a side view of the embodiment of the internal bladder of FIG. 19, wherein the internal bladder is removed from its protective cover.

Internal bladder 152 may comprise an inside facing surface and an outside facing surface, wherein the inside facing surface encompasses or engages the outside edges of the propeller 126 and the outside facing surface abuts the inside surface of the soft-shell enclosure. The internal bladder 152 may be disposed within an internal bladder sleeve 154 which may be attached to either the interior sidewalls and/or the bottom panel 122 and/or the rigid bottom member 158 with various fastening means, including detachable fastening means such as hook and loop fasteners, snap fasteners, zippers, buttons, etc., or non-detachable fastening means such as stitching, glue, etc. The internal bladder 152 will generally comprise an inflation means 156 for inflation of the internal bladder. As best shown in FIGS. 19-20, the inflation means 156 may comprise a inflation bulb of the type often used with manual blood pressure cuffs, wherein the inflating medium is air, and the bulb is manually operated. It is to be appreciated that other means of inflating the bladder may utilized, and other inflating mediums utilized to accomplish the same purpose.

As shown in FIGS. 14 through 21, embodiment 110 has a cylindrical shell 112, sides 114, an enclosure opening 118, means 120 in the form of a zipper for closing the enclosure, and means for securing the propeller 126 within the enclosure. The means for securing the propeller within the enclosure, which may be accomplished by securing the propeller, among other things, to the enclosure bottom panel 122 or, alternatively, to the rigid bottom member 158, may comprise straps 130, each strap having a first end 132 and a second end 134. First end 132 may be attached to the enclosure bottom panel 122 or to the rigid bottom member 158. Second end 134 may comprise means for either connecting to the second end of an adjacent strap 130, or for connecting directly to the propeller or to a member which engages propeller 126. The strap 130 may further comprise cover sleeves 148 which may protect the strap from being damaged by the blades of the propeller 126.

Figure 21:
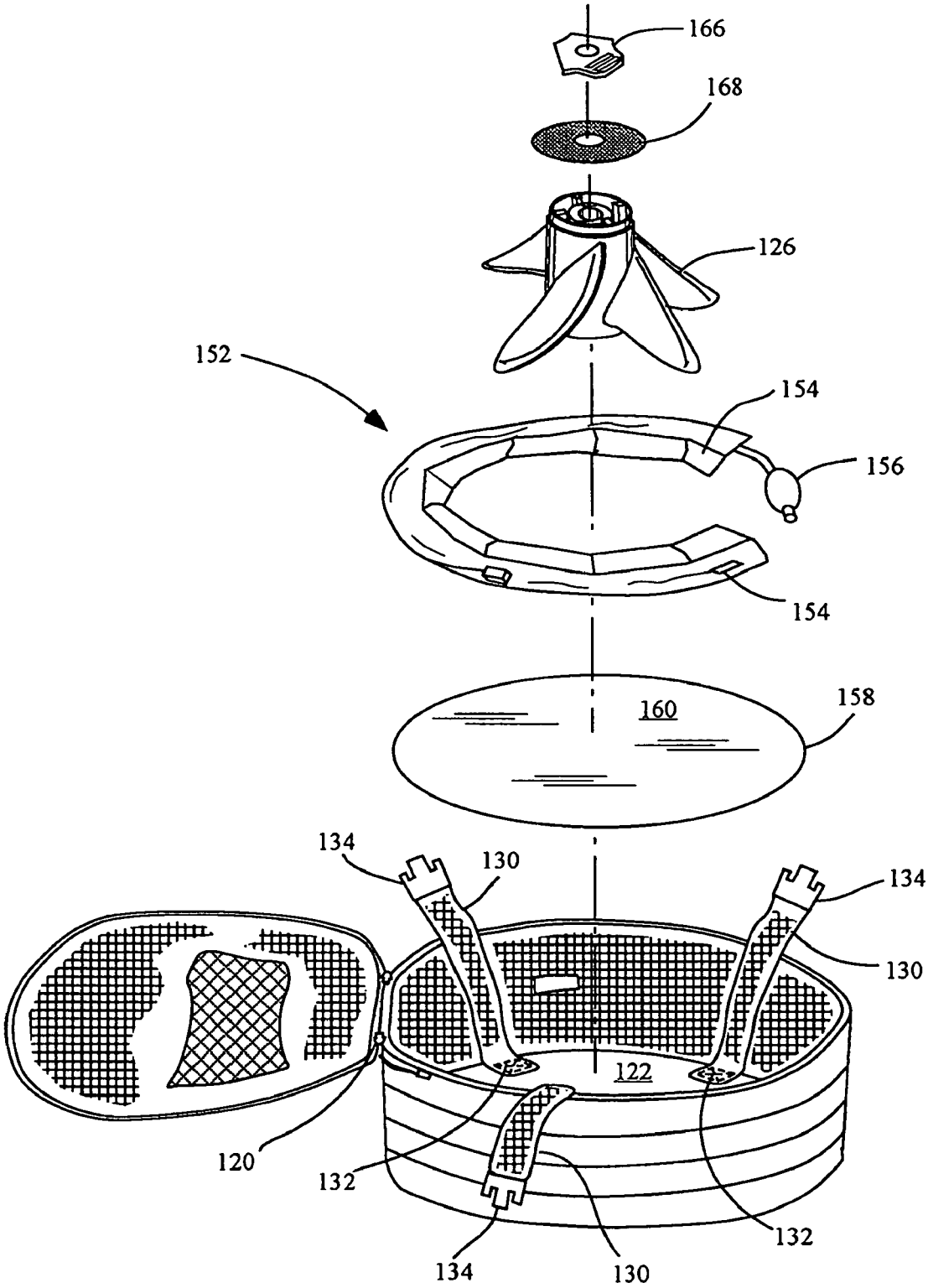
FIG. 21 is an exploded perspective view of the embodiment shown in FIG. 13.

As best shown in FIG. 21, the apparatus may further comprise hub cover 168. Buckle 166 may be configured such that it is a three-way device which allows three separate straps 130 to meet at approximately the center of the hub cover 168, with each strap adjusted to be approximately the same length. Buckle 166 and the second ends 134 of the straps 130 may be configured such that the second ends have rapid connect/disconnect capability. For example, straps 130 may be of an elastic material, and second end 134 may comprise a hook or plate which engages a hole or slot on buckle 166. The apparatus may also comprise carrying means 146, where the carrying means may comprise a continuous loop strap which is attached to the sides or outside of the enclosure.

Figure 15:
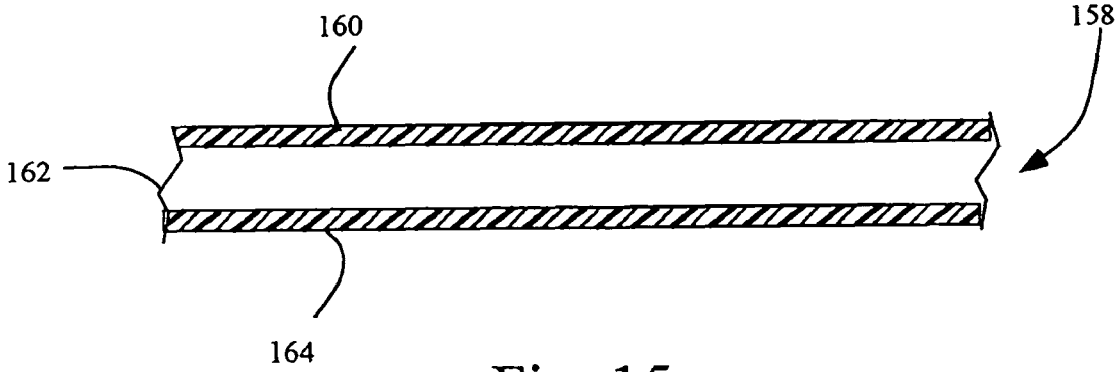
FIG. 15 schematically shows a partial cross sectional view of an embodiment of the rigid bottom member.

FIG. 15 schematically shows a cross sectional view of an embodiment of the rigid bottom member 158. This embodiment comprises an inward-facing layer 160 constructed of a water-resistant material, a center layer 162 constructed of a shock and impact absorbing material, and an outward-facing layer 164 constructed of a water-resistant material. The rigid bottom member 158 provides additional support to propeller 126 and evenly distributes the weight of the propeller to the enclosure bottom panel 122.

Figure 14:
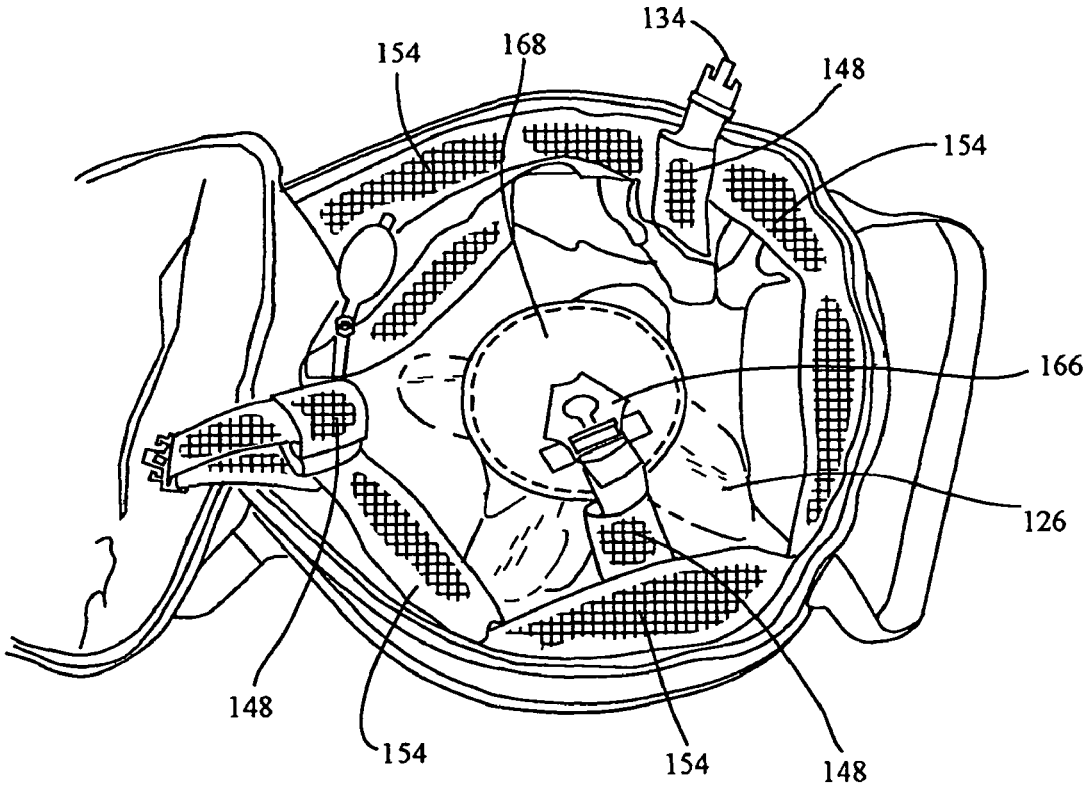
FIG. 14 shows a top view of the embodiment shown in FIG. 13.
Figure 16:
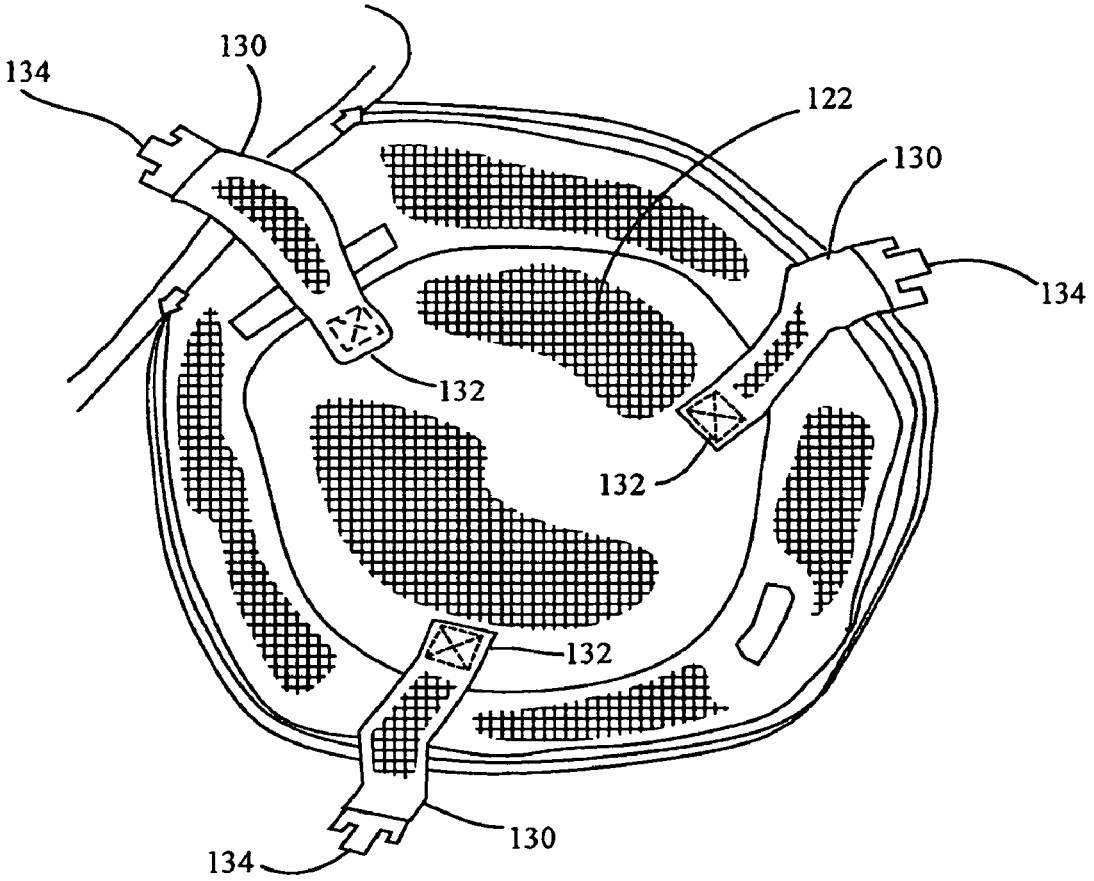
FIG. 16 shows the embodiment of FIG. 13 with the propeller and inflatable support and protection means removed.
Figure 17:
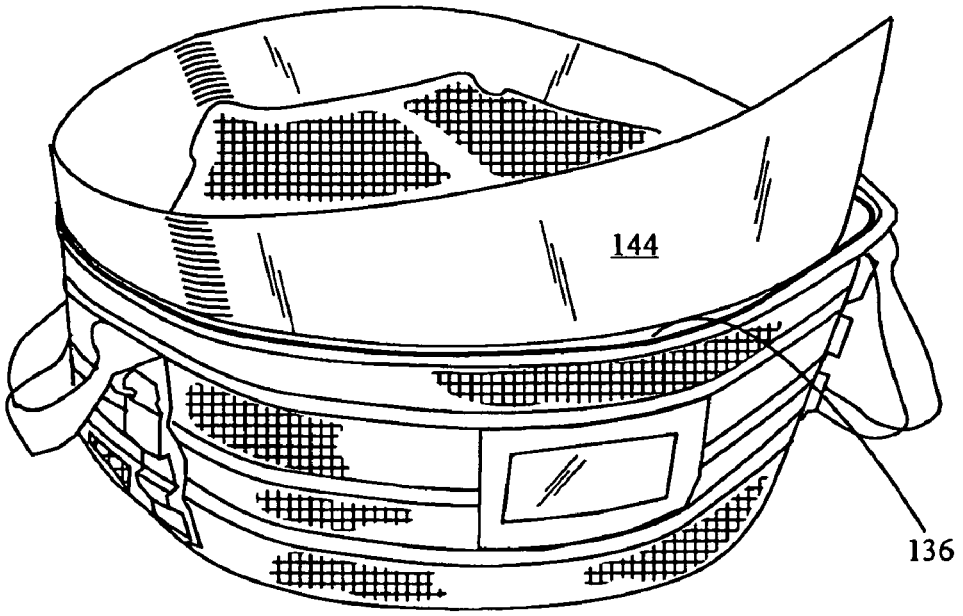
FIG. 17 shows the side insert partially removed from the pouch of the embodiment shown in FIG. 13.

FIG. 16 depicts an embodiment of the device where the means for securing the propeller within the enclosures is accomplished by securing the propeller to the enclosure bottom panel 122 utilizing a plurality of straps 130 attached to enclosure bottom panel 122. Each strap 130 in this embodiment comprises a second end 134 which is adapted to attach to a connecting member, such as buckle 166, as best shown in FIGS. 14 and 21.

Figure 18:
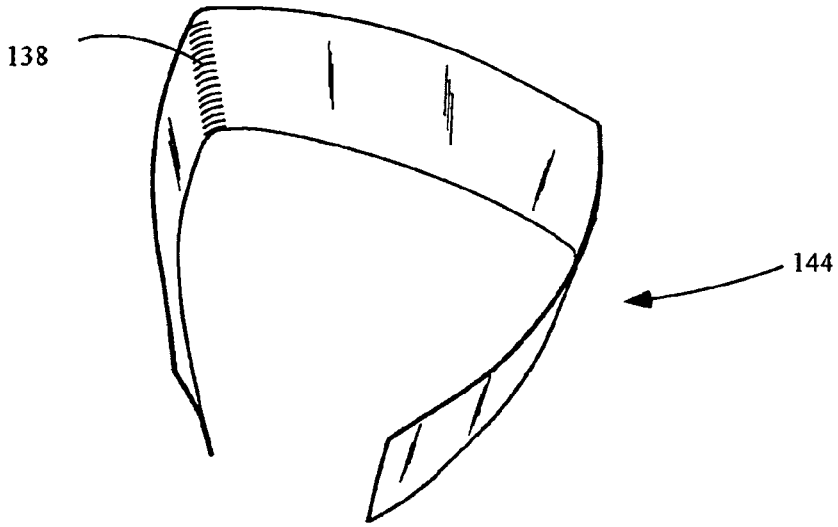
FIG. 18 is a perspective view of the side insert removed from the pouch.

The sides of the enclosure 114 may comprise a dual-wall construction comprising an inner wall and outer wall, the space between the inner wall and the outer wall defines a pouch 136. The opening of the pouch 136 may comprise closing means such as a zipper, snap buttons or hook and loop fasteners. The pouch 136 may contain an insert 144 which is fabricated from shock and impact absorbing material. The insert 144 is sized to fit within the space defined by the pouch 136. As shown in FIG. 18, the insert 144 may comprise a three piece construction, where each piece is connected with nylon webbing 138. This method of construction allows for removing the insert 144 and folding the device into a decreased profile for storage when there is no propeller 126 being carried or stored within the device.

While the above is a description of various embodiments of the present invention, further modifications may be employed without departing from the spirit and scope of the present invention. Thus the scope of the invention should not be limited according to these factors, but according to the claims to be filed in the forthcoming utility application.

What is claimed is:

1. An apparatus storing and transporting boat propellers, the propellers of the type having a hub and blades radiating outwardly from the hub, the apparatus comprising:

a soft-shell enclosure having a top, sides, and a panel defining the bottom of the enclosure, the enclosure having an opening, wherein the opening of the enclosure comprises closing means, wherein the sides of the enclosure comprise a dual-wall construction comprising an inner wall and outer wall, the space between the inner wall and the outer wall defining a pouch, the pouch having a opening;

a rigid bottom member which overlies the panel on the bottom wherein the rigid bottom member comprises an inward facing layer comprising a water-resistant material, a center layer constructed of a shock and impact absorbing material, and an outward facing layer constructed of a water-resistant material, said layers disposed in a sandwich configuration;

an internal bladder adapted to encircle the propeller, the internal bladder comprising inflation means;

carrying handle means, wherein the carrying handle means comprises a continuous loop strap which is attached to the sides of the enclosure, and which extends above each side of the enclosure in matching loops;

a hub cover for disposing against the hub of the propeller; and a plurality of three fastening straps for securing the propeller within the enclosure, the fastening straps having a first end and a second end, the first ends respectively attached to the bottom of the enclosure and the second ends each removeably attached to a three-point buckle member, said buckle member abutting the hub cover and said fastening straps extending between adjacent blades thereby restricting movement of the propeller.

2. The apparatus of claim 1 wherein an insert fabricated from shock and impact absorbing material is disposed within the pouch.

3. The apparatus of claim 2 wherein the insert comprises a plurality of adjacent panel members, wherein the edges of adjacent panel members are connected together with a flexible material.

4. The apparatus of claim 1 wherein the first ends of the fastening straps are respectively attached to the panel defining the bottom of the enclosure.

5. The apparatus of claim 1 wherein the first ends of the fastening straps are respectively attached to the rigid bottom member.

* * * * *